US005803805A

United States Patent [19]

Sells

[11] Patent Number: 5,803,805

[45] Date of Patent: Sep. 8, 1998

[54] STRUCTURE VENTILATING DEVICE

[76] Inventor: Gary L. Sells, P.O. Box 428, Mishawaka, Ind. 46546-0428

[21] Appl. No.: 799,779

[22] Filed: Feb. 12, 1997

[51] Int. Cl.[6] ..... F24F 7/02

[52] U.S. Cl. ..... 454/364; 454/365; 454/359; 454/260; 454/368; 52/199

[58] Field of Search ..... 454/364, 365, 454/353, 359, 260, 368; 52/199, 57

[56] References Cited

U.S. PATENT DOCUMENTS 4,399,738 8/1983 Sharkey .
4,624,176 11/1986 Steinke .
4,667,581 5/1987 Hovland .
5,509,445 4/1996 Couet .
5,603,657 2/1997 Sells ..... 454/359

*Primary Examiner*—Harold Joyce
*Assistant Examiner*—Derek S. Boles
*Attorney, Agent, or Firm*—Baker & Daniels

[57] ABSTRACT

A ventilating device for a home or other building includes a frame for covering a ventilating opening in the structure. The frame defines a passage for communicating the ventilating opening to the atmosphere. The passage contains a freely movable valve member which normally rests in an inactive position under gravitational force to permit venting through the passage. The valve member moves in response to wind pressure to an active position in which the member seats against a seating surface within the passage to prevent entry of wind-driven precipitation into the structure. When the wind subsides, the valve member returns under the force of gravity to its inactive position.

23 Claims, 8 Drawing Sheets

346
356
337
339
333
368

434
446
435
436
433
432

237
239
256
264
246
233
254

39
37
34
33
31
46
35
32

STRUCTURE VENTILATING DEVICE

FIELD OF THE INVENTION

The present invention relates to a structure ventilating device which includes a freely movable valve member that blocks communication of wind driven precipitation through the device.

BACKGROUND OF THE INVENTION

Devices for ventilating interior spaces within structures, particularly upper floors and attics of dwellings and other buildings, are used to prevent excessive heat build-up and to remove moist air within the interior spaces. One such device shown in U.S. patent application Ser. No. 08/269,916, filed Jun. 30, 1994, provides a ventilating cover for an elongated ventilating opening formed along the roof ridge of a structure. The cover includes passages to communicate excess heat and moist air from the interior of the structure to the ambient air and flaps or baffles which respond to wind pressure by deforming or pivoting to cover the passages and prevent entry of wind-driven moisture into the ventilating opening. Accordingly, it is desirable to provide adequate ventilation while preventing entry of moisture, such as snow or rain, into the interior space of a structure.

SUMMARY OF THE INVENTION

The present invention provides a structure ventilating device having freely movable valve members, either cylindrical or spherical in shape, contained within passages that communicate the structure interior to the ambient atmosphere. The valve members are normally retained by gravity in an opened position, opening the passages. When the wind pressure entering a passage overcomes the gravitational force acting on the valve member contained therein, the valve member is urged along an inclined plane against a valve seat within the passage to block the passage and prevent ingestion of wind-driven moisture into the structure interior. Tapered surfaces within the passages guide the valve member into its seated, closed position.

Accordingly, an object of the invention is to provide a structure ventilating device which vents heated and moist air from within a structure to the atmosphere while preventing moisture carried by high winds from entering the structure.

Another object of the invention is to provide a structure ventilating device which employs a freely moving valve member that blocks airflow through the device in response to wind pressure entering the device.

BRIEF DESCRIPTION OF THE DRAWINGS

The above-mentioned and other objects and advantages of the present invention, and the manner of attaining them, will become more apparent and the invention will be better understood by reference to the following description of embodiments of the invention taken in conjunction with the accompanying drawings, wherein.

Figure 1:
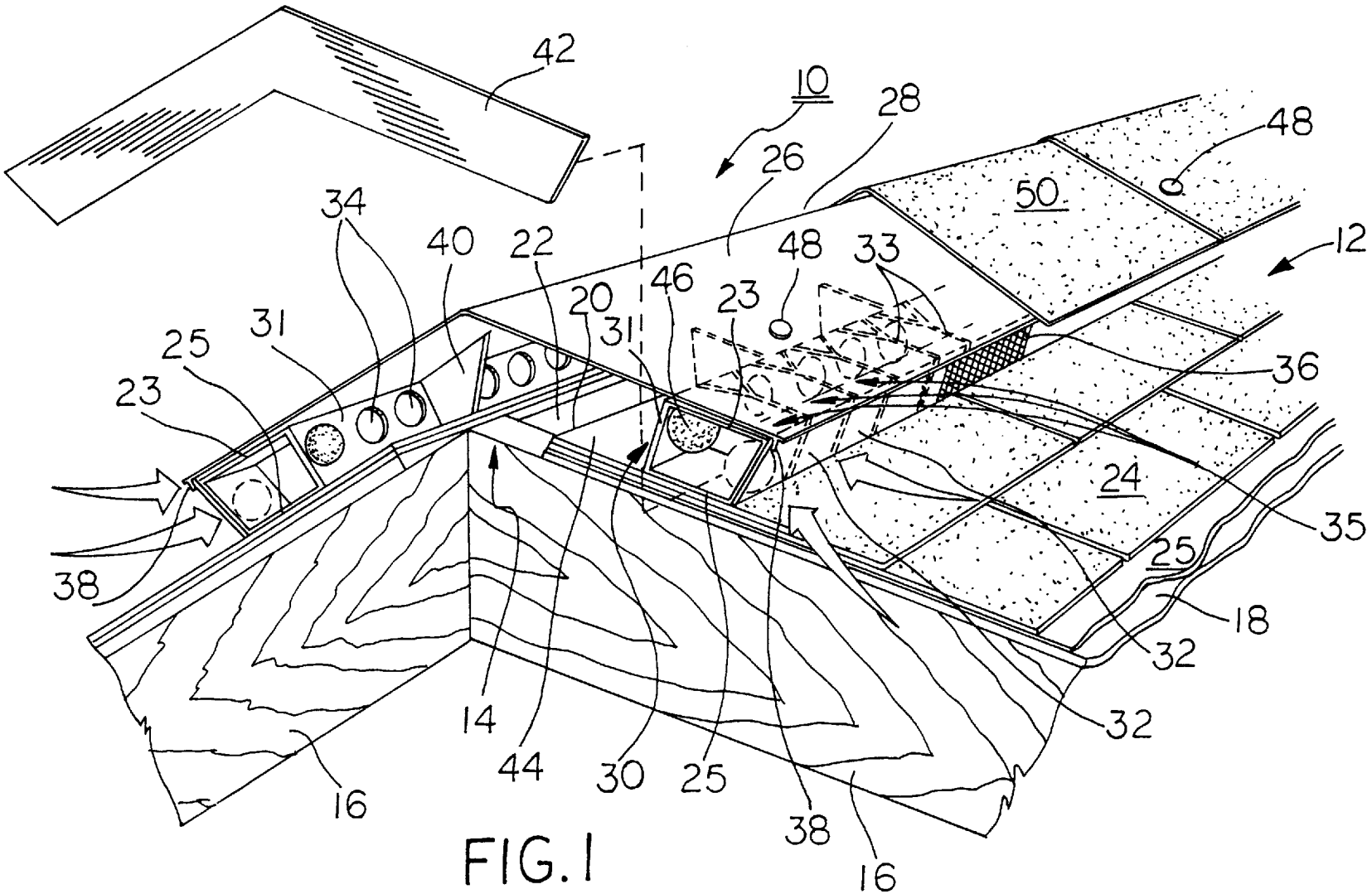
FIG. 1 is a partially sectionalized, fragmentary perspective view of a structure ventilating device according to the present invention applied over a ventilating opening along the ridge of a roof.

Corresponding reference characters indicate corresponding parts throughout the several views. Although the drawings represent embodiments of the present invention, the drawings are not necessarily to scale and certain features may be exaggerated in order to better illustrate and explain the present invention.

DESCRIPTION OF THE INVENTION

The embodiments herein described are not intended to be exhaustive or to limit the invention to the precise forms disclosed. Rather, the embodiments selected for the description are disclosed so that others skilled in the art may utilize their teachings.

FIG. 1 shows the ventilating device of the present invention generally referred to by the numeral 10, adapted for installation on the ridge or peak 14 of structure 12. Ridge 14 is of the type commonly found in buildings with an enclosed attic area or enclosed rafter spaces (for example, above a cathedral ceiling) which are separated from the dwelling area below. Inclined roof rafters 16 meet at ridge 14. Underlayment 18, such as plywood or other suitable material, spans the distances between rafters 16. The upper edges 20 of underlayment 18 do not meet, but rather define a longitudinally extending gap or ventilating opening 22 along the length of ridge 14. Roofing shingles 24 are applied in the standard fashion over felt paper 25 applied to underlayment 18.

Ventilating device 10 includes a V-shaped frame or cap 26 which extends across ventilating opening 22. Cap 26 is divided into portions by a central bend 28 which permits device 10 to conform to a variety of roof pitches. Cap 26 is rigidly attached to structure 12 using shingle fasteners 48 or other similar fasteners. Additional shingle fasteners 48 are used in the standard fashion to attach shingle caps 50 to the upper surface of cap 26. Cap 26 covers longitudinally extending housings 30.

Figures 1A, 3A, 4A, 6A:
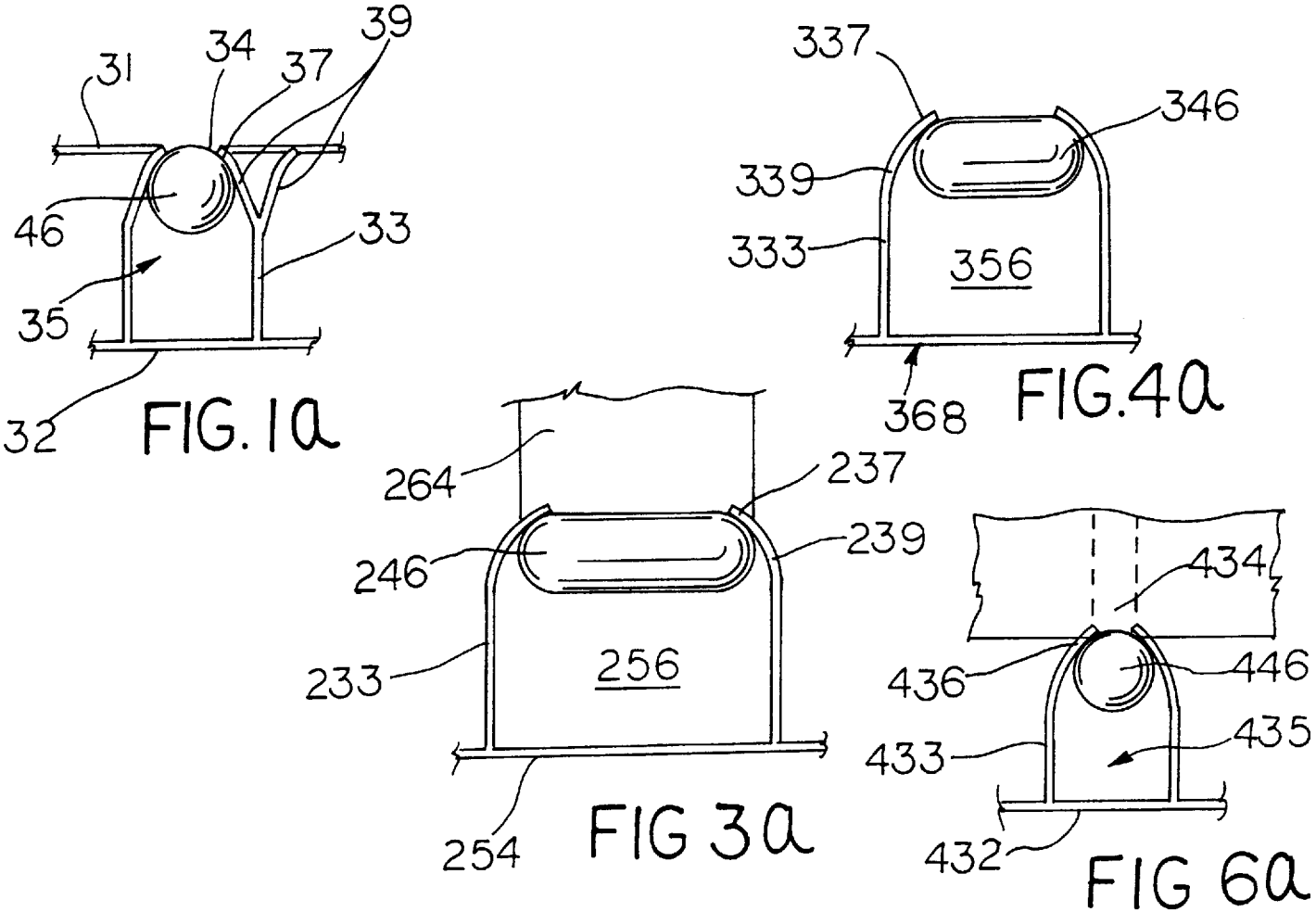
FIG. 1*a* is a partially sectionalized, fragmentary, top plan view of the device of FIG. 1.
FIG. 3*a* and 4*a* are partially sectionalized, fragmentary, top plan views of the embodiments of FIG. 3 and 4, respectively.
FIG. 6*a* is a partially sectionalized, fragmentary, top plan view of the device of FIG. 5.

Each housing 30 includes a top wall 23, a bottom wall 25, an inner wall 31, and a plurality of divider walls 33. Each top wall 23 is attached to a respective portion of cap 26. Each bottom wall 25 is mounted on top of shingles 24 and includes an upper surface which is inclined upwardly according to the pitch of the roof. In an exemplary embodiment, each inner wall 31 defines a plurality of spaced, circular intake openings 34. Divider walls 33 extend outwardly from each inner wall 31 between intake openings 34 to define a plurality of compartments or passages 35 with exhaust openings 32. As best shown in FIG. 1*a*, divider walls 33 split into a pair of taper walls 39 which extend toward intake openings 34 to guide valve members 46 toward intake openings 34 as further explained below. Each taper wall 39 terminates in a curved sealing segment 37 which sealingly engages with valve members 46 when the valve members move to intake openings 34.

A series of support webs 40 extend inwardly from inner walls 31 and downwardly from cap 26. A screen 36 extends across the exhaust openings 32 below a lip 38 formed at the outwardly facing edges of cap 26. An end cap 42 is removably attached to the exposed end 44 of ventilating device 10. Enclosed within each of the passages 35 is a valve member 46 which is freely movable between screen 36 and inner wall 31. In this embodiment, valve member 46 is spherical in shape and made of lightweight plastic, styrofoam, or other suitable material. In other embodiments described herein, valve members 46 are cylindrical in shape.

MODE OF OPERATION

In operation, valve members 46 respond to ambient wind conditions to either permit or obstruct airflow through passages 35. When the air flow toward the exhaust openings 32 (shown as arrows in FIG. 1) is at or below a predetermined wind force, valve members 46 rest against screens 36 (as shown in dotted lines in FIG. 1) under the force of gravity. Valve members 46 normally remain in this inactive, opened position. When valve members 46 are in this opened position, air may freely flow out ventilating opening 22, through passages 35, and out exhaust openings 32 to the atmosphere, thereby venting the internal air of structure 12 through ventilating device 10. Under these low wind conditions, rain, other forms of moisture, and various debris, are prevented from entering the interior of structure 12 by screens 36, the inclined attitude of passages 35, and the overhanging lip 38 of cap 26.

When the ambient wind conditions become adverse, commonly during rain or snowstorms, valve members 46 prevent wind driven precipitation from entering ventilating opening 22. When the wind force against valve members 46 exceeds the gravitational force holding valve members 46 against screens 36, valve members 46 move upwardly along the inclined plane formed by bottom wall 25 toward intake openings 34, guided by taper walls 39. The valve members 46 seat against curved segments 37 within intake openings 34 (solid lines in FIG. 1) to block the flow of air and precipitation to the interior of structure 12. Valve members 46 remain seated in intake openings 34 so long as the ambient wind pressure exceeds a predetermined force. When the ambient wind speed subsides to a level below the predetermined value, valve members 46 roll downwardly along the inclined plane of bottom wall 25 toward exhaust openings 32 and again rest against screens 36, thereby restoring venting through ventilating opening 22 to the ambient atmosphere.

As should be apparent to one skilled in the art, the weight of valve members 46, the incline of rafters 16 and the corresponding inclined plane of bottom wall 25 affect the amount of wind pressure required to move valve members 46 from their opened position (against screens 36 which extend across exhaust openings 32) to their closed or active position (seated against intake openings 34). The weight and material of valve members 46 may be selected such that relatively slight ambient wind force will move valve members 46 from their opened position to their closed position. For example, relatively lightweight valve members 46 may be produced for applications that specify passages 35 which close in response to relatively low wind pressure. Heavier valve members 46 may be installed in identical passages 35 for applications that specify passages 35 which remain opened until wind pressure becomes relatively high. Such passage and valve member combinations could further be produced as standardized, interchangeable units.

Figure 2:
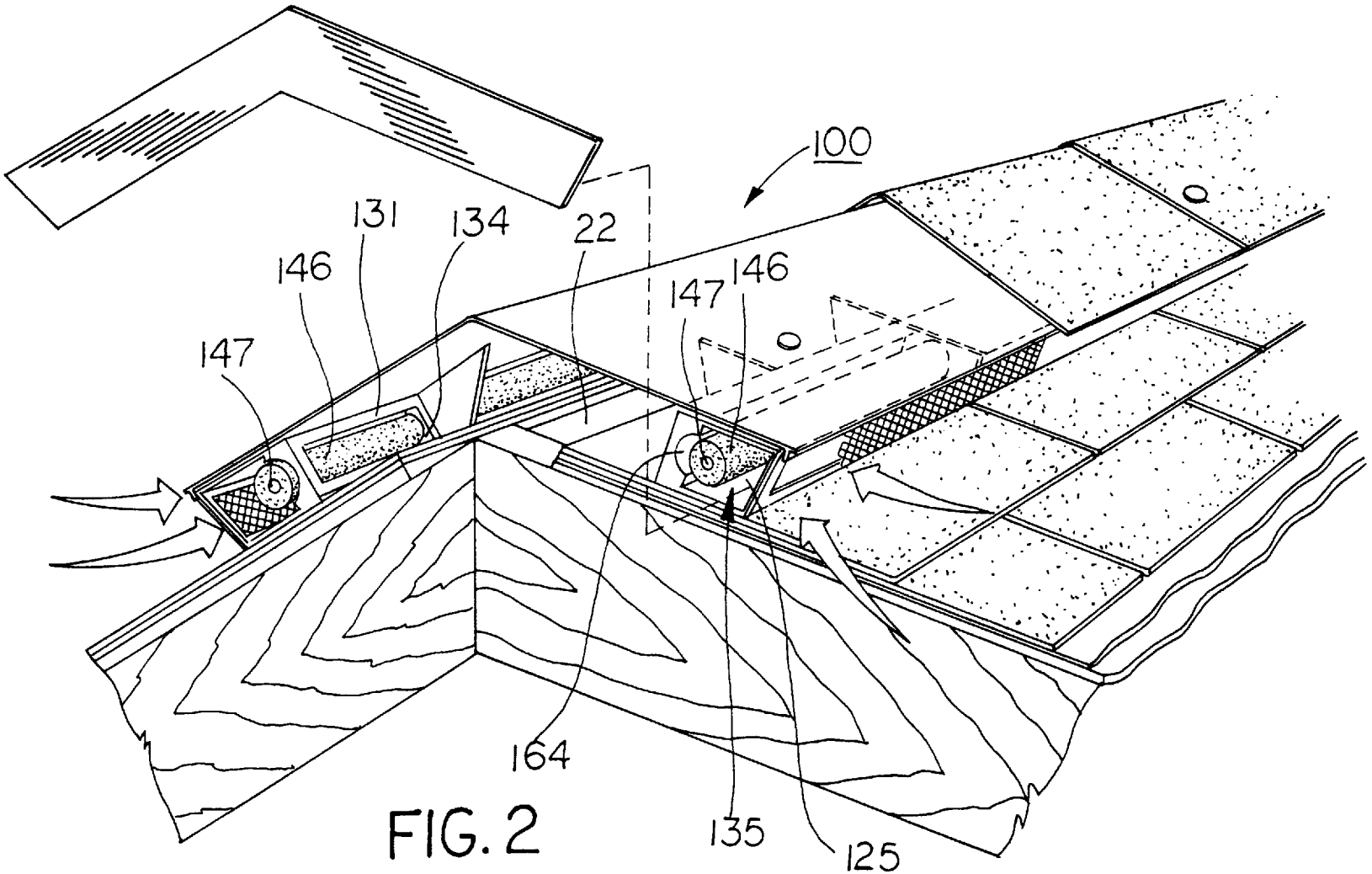
FIG. 2 is a view similar to FIG. 1, illustrating another embodiment of the present invention.

FIG. 2 depicts an alternate embodiment of the basic concept of the present invention. The basic structure of ventilating device 100 is substantially the same as that of ventilating device 10, and the same or similar elements are given the same reference numbers as those described above except that they are increased by 100. In ventilating device 100, the width of passages 135 (in the direction parallel to ventilating opening 22) has been increased to accommodate cylindrical valve members 146. Interior walls 131 define elongated cylindrical slots 134 which correspond to intake openings 34 of ventilating device 10. Interior walls 131 also include arcuate notches 164. Valve members 146 seat against arcuate notches 164 when moved upwardly along the inclined surface of bottom walls 125 in response to ambient wind conditions from their opened position to their closed position (solid lines in FIG. 2) as described for device 10 above. The length of cylindrical valves members 146 should be relatively short, preferably approximately six inches, so as to avoid warpage and misalignment. Stiffening bars 147 may also be used to maintain the shape of valve members 146.

Figure 3:
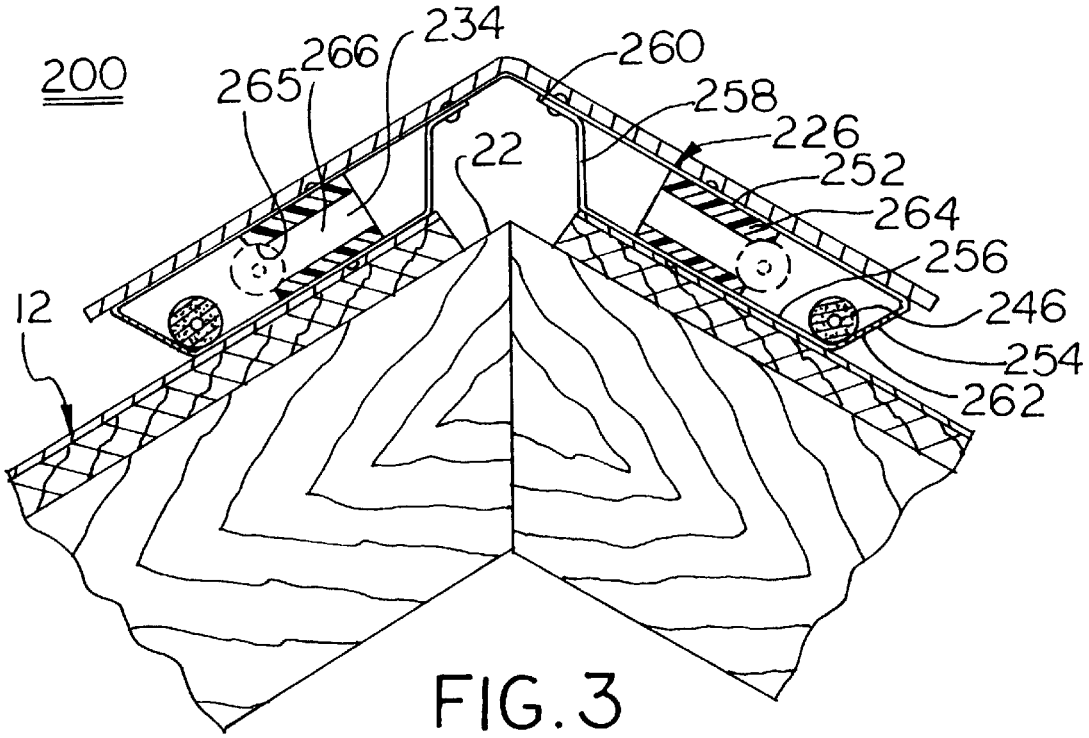
FIG. 3 and 4 are cross-sectional views of additional embodiments of the basic design of FIG. 2.
Figure 4:
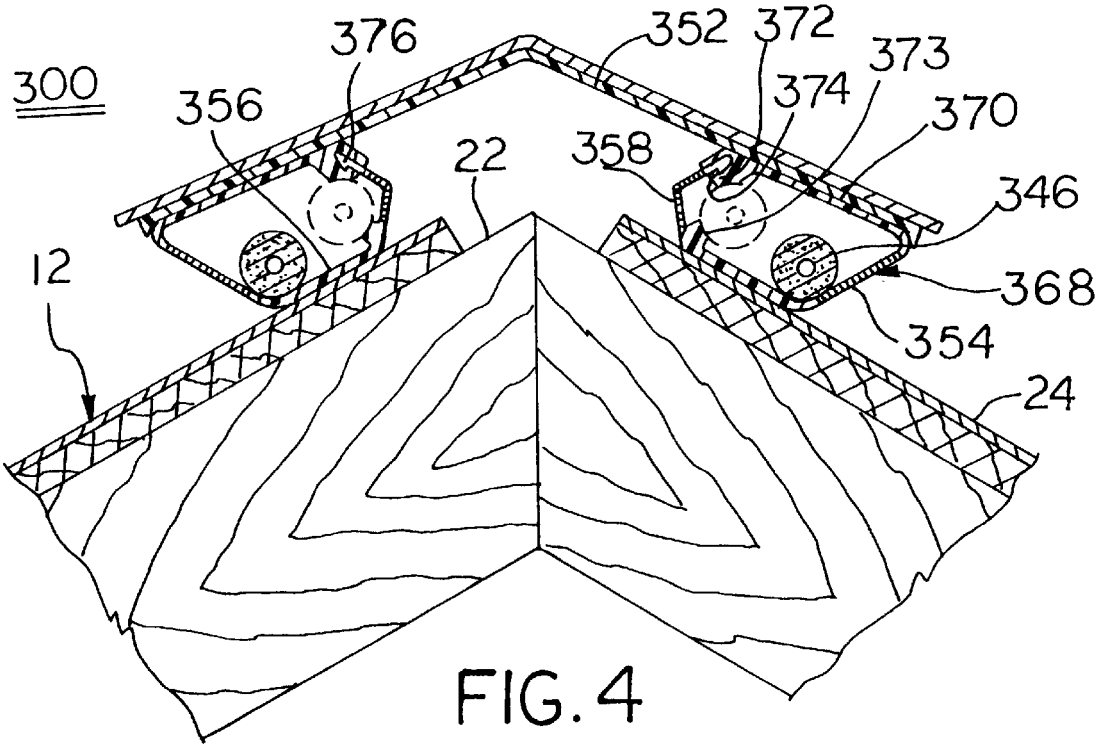

FIGS. 3 and 4 show alternative versions of device 100. In FIG. 3, device 200 includes cap 226 which is bent from a substantially singular piece to form top walls 252, outwardly facing walls 254, bottom walls 256, inwardly facing walls 258, and attachment flanges 260. Attachment flanges 260 are attached to top walls 252 using common fasteners. Outwardly facing walls 254 define perforations 262. Block portions 264 are attached between top walls 252 and bottom walls 256 defining passages 266 which terminate in intake openings 234. Like device 100, when sufficient wind blows through perforations 262, valve members 246 move along the inclined plane of bottom walls 256 from their opened position (solid lines) to their closed position (dotted lines). As shown in FIG. 3*a*, taper walls 239 guide valve members 246 into their closed position. When in their closed position, valve members 246 seat within the curved surfaces 265 defined by blocks 264 and the curved sealing segments 237 of taper walls 239, thereby blocking passages 266.

Device 300 of FIG. 4 includes inclined top walls 352 and passage enclosures 368 which correspond to housings 30 of device 10. Enclosures 368 include top walls 370 which are attached to the underside of inclined cap 352, perforated inner walls 358, bottom walls 356, and perforated outer walls 354. Ridges 372 with radiused surfaces 373 extend downwardly from top walls 370 and upwardly from bottom walls 356 along the upper and lower edges of each inner wall 358. Radiused surfaces 373 correspond to the radius of valve members 346. The inwardly directed edge of each top wall 370 terminates in an elongated channel 374 which is adapted for interlocking engagement with free edge 376 of a respective inner wall 358. Accordingly, valve members 346 may be installed into or removed from passage enclosures 368 before device 300 is installed on structure 12 by disengaging free edges 376 from channels 374 and bending inner walls 358 downwardly toward shingles 24.

When the wind force through perforated outer walls 354 is sufficient, valve members 346 roll along the inclined plane of bottom walls 356 from their opened position (solid lines)

to their closed position (dotted lines), wherein valve members 346 engage radiused surfaces 373 of ridges 372 to prevent wind driven moisture from entering the interior space of structure 12 through ventilating opening 22. As shown in FIG. 4*a*, taper walls 339 guide valve members 346 into their closed position wherein valve members are seated against curved sealing segments 337 of taper walls 339.

Figure 6:
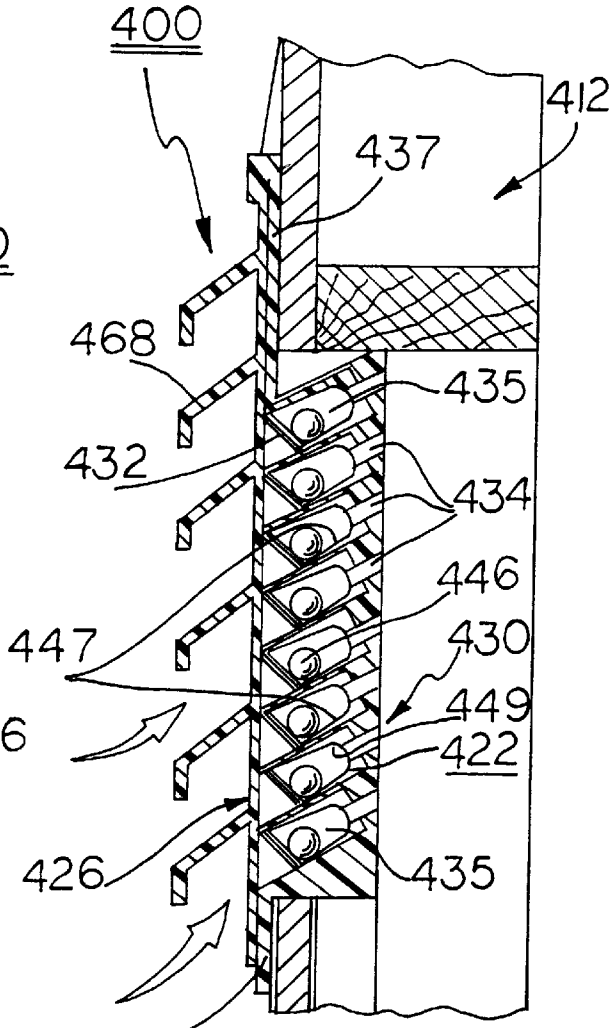
FIG. 6 is a cross-sectional view of the device shown in FIG. 5 taken substantially along line 6—6.
Figure 5:
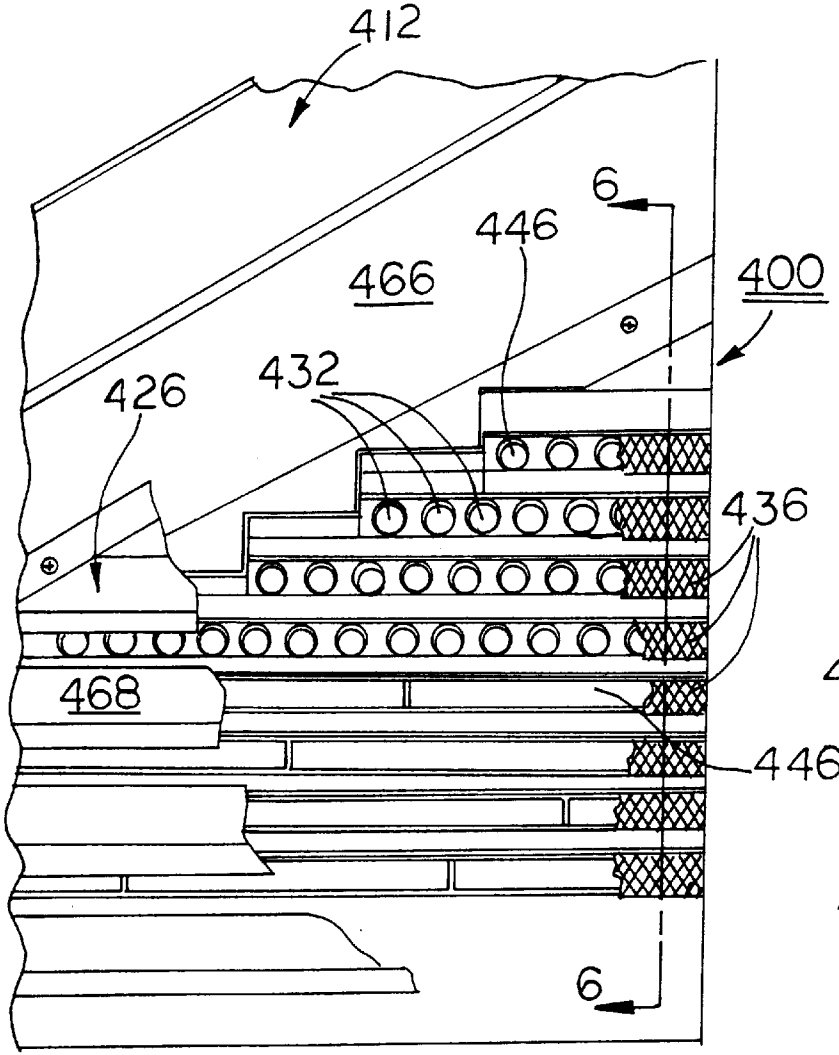
FIG. 5 is a front elevational view, partly in section, of another embodiment of the present invention applied over a ventilating opening in a gable end of a structured.

FIGS. 5, 6 and 6*a* show another embodiment of the basic concept of the present invention adapted to accommodate venting through ventilation opening 422 defined in the gable end 466 of a structure 412. As best seen in FIG. 6, cap 426 includes a series of awning portions 468 which are connected to housing 430. Housing 430 includes mounting flanges 437 and defines a plurality of passages 435. Passages 435 include intake openings 434, exhaust openings 432, inclined planes 447, and tapered divider walls 433 which terminate in curved seating segments 436. Passages 435 also contain valve members 446. Intake openings 434 have radiused surfaces 449 which correspond to the radius of valve members 446 to ensure proper seating. Exhaust openings 432 are shielded from moisture and debris by awning portions 468 and screens 436. Passages 435 are aligned in rows which may be constructed in increasing widths to conform to the incline of the gable end framework as shown in FIG. 5.

For illustrative purposes, FIGS. 5 and 6 show spherical valve members 446 in the upper rows of passages 435 and cylindrical valve members 446 in the lower rows of passages 435. It should be apparent from the foregoing, however, that passages 435 could readily be modified to accept all spherical or all cylindrical valve members 446. Valve members 446 permit air flow between ventilating opening 422 and the ambient atmosphere when in the inactive or opened position shown in FIG. 6. When the ambient wind speed entering exhaust openings 432 exceeds the amount required to move valve members 446 up inclined planes 447 of passages 435 and into sealing engagement with radiused surfaces 449 of intake openings 434, the air flow through passages 435 becomes blocked, thereby preventing ingestion of wind-driven debris and moisture into structure 412. Again, tapered divider walls 433 guide valve members 446 into their closed position wherein the valve members also seat against seating segments 436.

Figure 7:
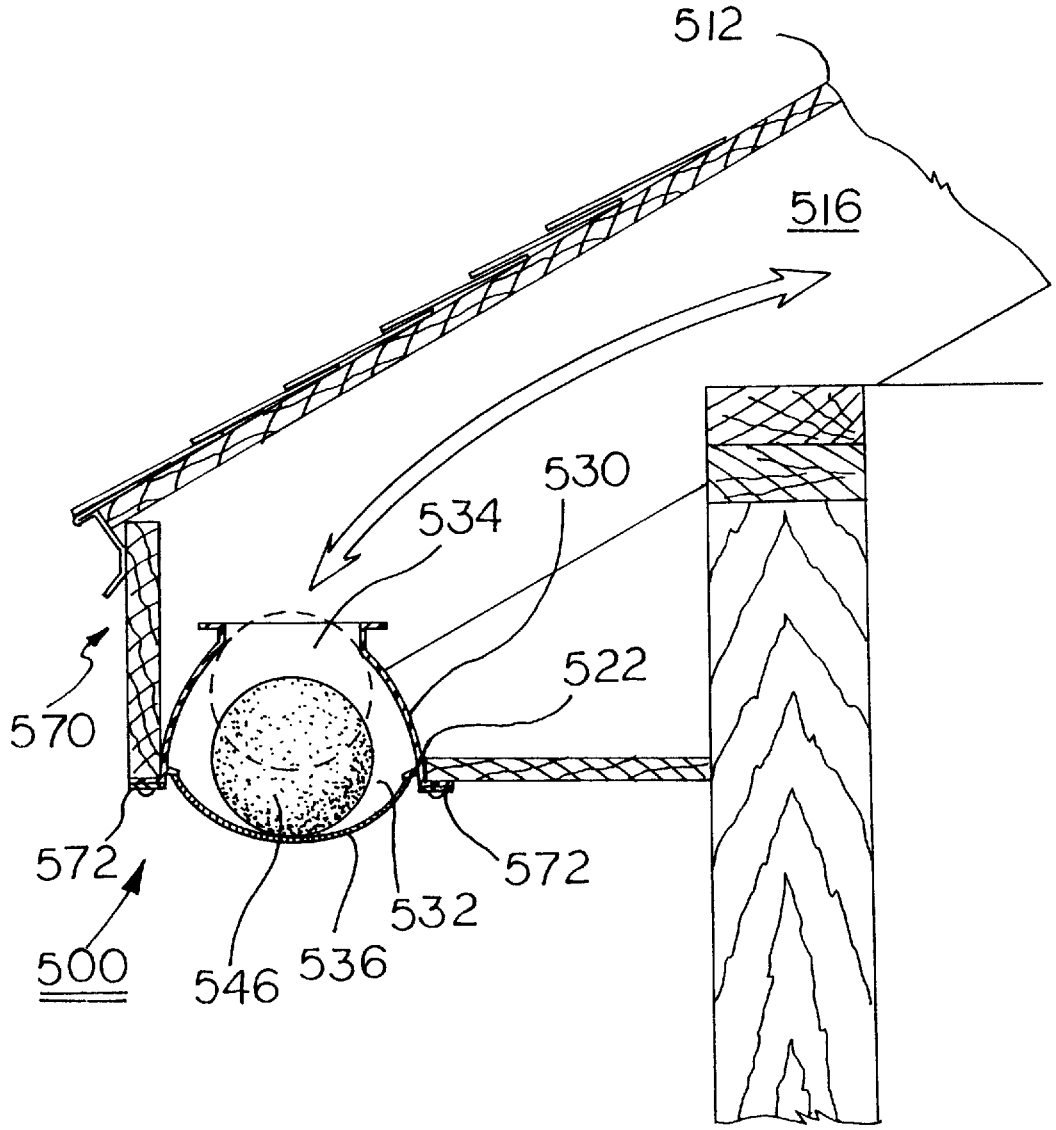
FIG. 7 is a partially sectionalized, fragmentary side view of another embodiment of a structure ventilating device according to the present invention applied over a ventilating opening in an overhanging soffit of a structure.

FIG. 7 shows yet another embodiment of the present invention designed for installation in a ventilating opening 522 formed in a soffit, generally referred to by the numeral 570, of a structure 512. Ventilating device 500 of FIG. 7 includes grill or screen 536 which spans exhaust opening 532 formed by housing 530. Housing 530 includes mounting lips 572 which are attached to soffit 570 using standard fasteners. The other end of housing 530 forms intake opening 534. A valve member 546 is enclosed within housing 530 and rests on top of screen 536 when in its inactive or opened position (shown in solid lines in FIG. 7). When in its inactive position, valve member 546 permits air flow from the interior portions of structure 512, between rafters 516, through intake opening 535, around valve member 546, and out exhaust opening 532, as suggested by the arrow in FIG. 7. Like the above-described embodiments, when the ambient wind pressure exceeds a predetermined amount, dependent primarily upon the weight of valve member 546, valve member 546 is lifted from its inactive position into its active or closed position wherein valve member 546 engages intake opening 534 (as shown in dotted lines in FIG. 7) to block air flow and prevent wind driven moisture from entering the interior portions of structure 512.

As should be apparent, housing 530 may readily be formed for mounting in a substantially square ventilating opening 522 cut through soffit 570. A spherical valve member 546 would be used within such a housing 530. Alternatively, housing 530 could readily be modified for mounting within a substantially rectangular opening 522 through soffit 570, wherein a cylindrical valve member 546 would be employed.

Figures 8, 8A:
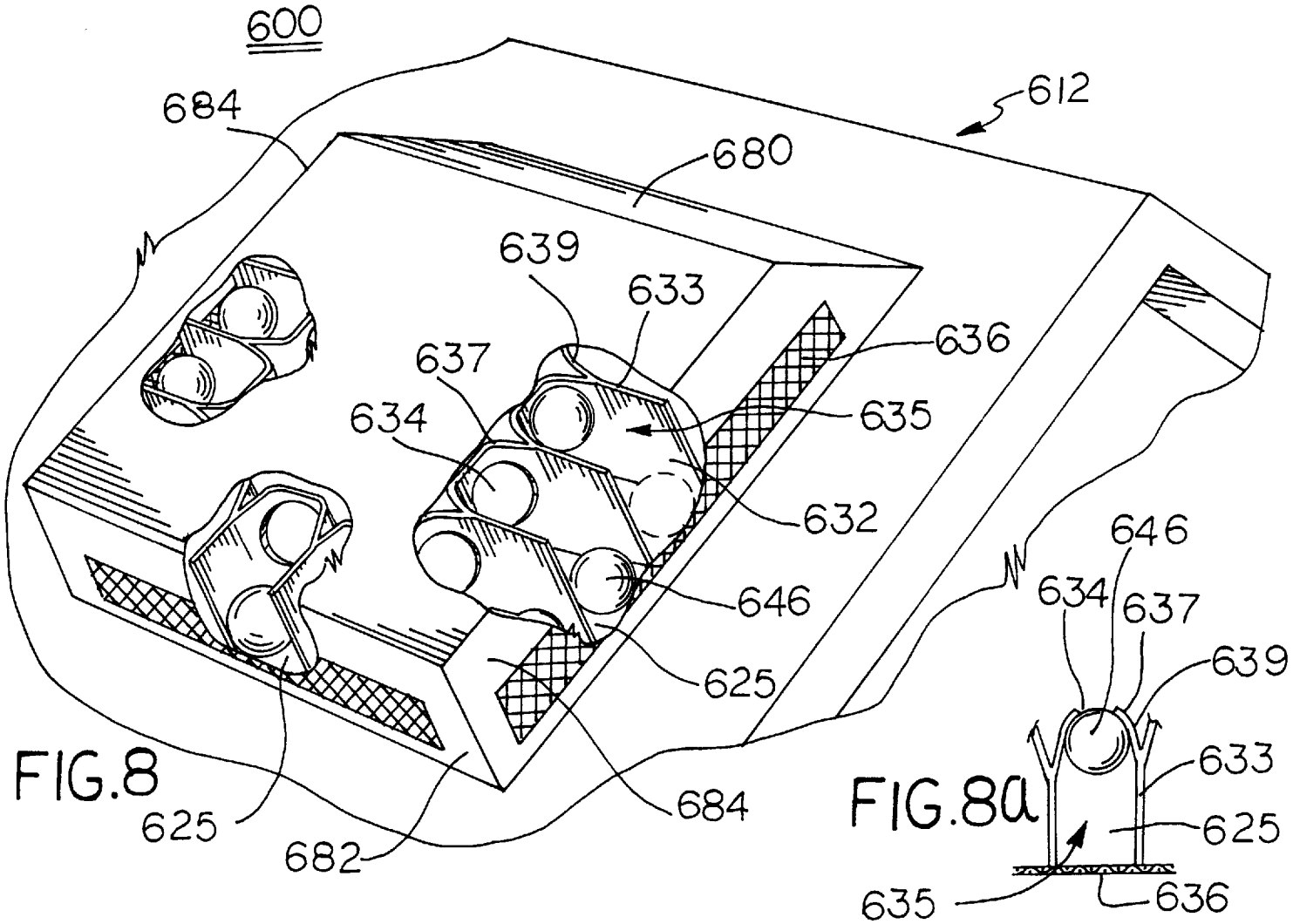
FIGS. 8 and 9 are partially sectionalized, fragmentary perspective views of embodiments of a structure ventilating device according to the present invention applied over a ventilating opening through an inclined roof.
FIGS. 8*a* and 9*a* are partially sectionalized, fragmentary, top plan views of the devices of FIGS. 8 and 9, respectively.

FIGS. 8 and 8*a* illustrate ventilating device 600 according to the present invention mounted over a ventilating opening (not shown) which extends through the flat, inclined portion of a roof of a structure 612. Device 600 is substantially rectangular in shape and includes ventilating passages 635 on three sides of the ventilating opening. The uppermost side 680 angles downwardly to the surface of the roof to divert precipitation running down the roof away from device 600 and to prevent accumulation of debris or snow. The passages 635 of the remaining three sides are similar to those employed in the above-described embodiments including bottom walls 625, divider walls 633, taper walls 639, sealing segments 637, intake openings 634 and exhaust openings 632 which are covered by screens 636. It should be apparent that the inclined surface of bottom walls 625 of the passages 635 on the downwardly facing side 682 urge valve members 646 into their opened position because of the slope of the roof, while the bottom walls 625 of the remaining two sides 684 must be constructed to slope downwardly relative to horizontal from intake openings 634 to exhaust openings 632.

Figures 9, 9A:
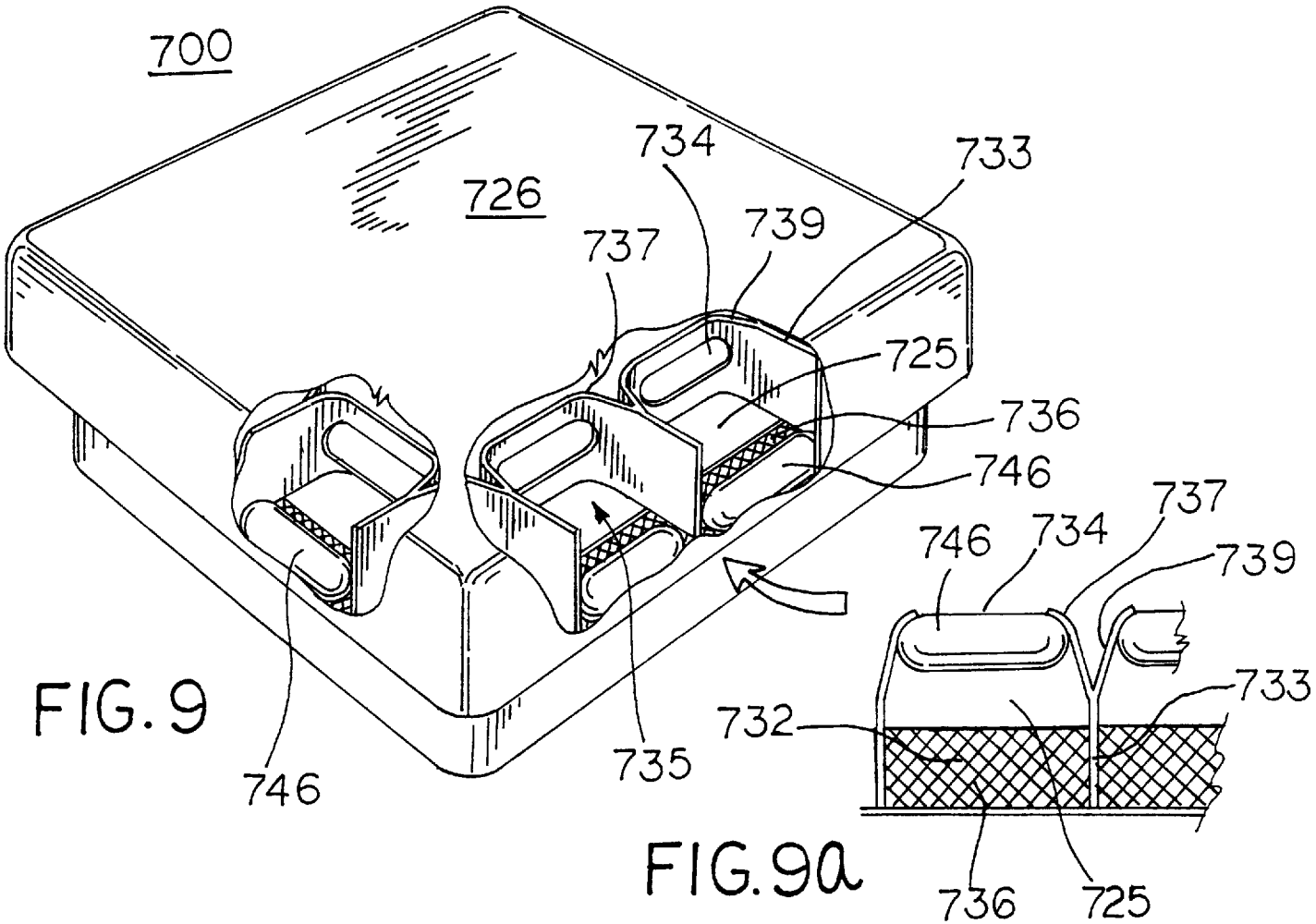

The device 700 of FIGS. 9 and 9*a* is quite similar to device 600 of FIGS. 8 and 8*a* and intended for application to the inclined roof of a structure. However, the exhaust openings 732 of device 700 are defined by bottom walls 725 which are spaced above the surface of the roof. Also, valve members 746 are cylindrical. The cap or cover 726 of device 700 protects ventilating opening (not shown, but centrally located under cover 726 in communication with intake openings 734) from ingestion of wind driven precipitation and debris under most conditions. When strong winds enter exhaust openings 732 (as suggested by the arrow in FIG. 9), valve members 746 roll from their opened position on screens 736 into sealing engagement with intake openings 734.

While this invention has been described as having exemplary embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A ventilating device for a structure having a ventilating opening, said device comprising:

a frame extending across said ventilating opening, said frame defining a passage extending from one end exposed to atmosphere to another end exposed to said ventilation opening, said other end being oriented above said one end for communicating said ventilating opening to ambient atmosphere; and a valve member enclosed within said passage movable between an opened position wherein said valve member is urged by gravity toward said one end of said passage to communicate said ventilation opening to atmosphere when the ambient wind speed is below a predetermined speed, said valve member being moved by ambient wind pressure toward said valve seat at said other end of said passage to block said passage to prevent ingestion of wind blown moisture into said structure through said ventilation opening when said ambient wind speed exceeds said predetermined speed.

2. A ventilating device as claimed in claim 1 wherein said valve member is spherical in shape.

3. A ventilating device as claimed in claim 1 wherein said valve member is cylindrical in shape.

4. A ventilating device as claimed in claim 1 further comprising a valve seat disposed within said passage, said valve member disengaged from said valve seat when in said opened position and engaging said valve seat when in said closed position.

5. A ventilating device as claimed in claim 4 wherein said passage includes an exhaust opening communicating said passage and the ambient atmosphere and an intake opening communicating said passage and said ventilating opening, said valve member obstructing said intake opening when engaging said valve seat.

6. A ventilating device as claimed in claim 1 wherein said passage defines an inclined plane from said exhaust opening to said intake opening, said valve member moving along said inclined plane when moving between said opened and said closed positions.

7. A ventilating device as claimed in claim 5 further comprising a screen extending substantially across said exhaust opening.

8. A ventilating device as claimed in claim 7 wherein said valve member engages said screen when in said opened position.

9. A ventilating device as claimed in claim 4 wherein said valve seat is substantially circular in shape and said valve member is substantially spherical in shape, said valve seat including a radiused surface corresponding to the radius of said valve member.

10. A ventilating device for a structure having a ventilating opening, said device comprising:

a frame traversing said ventilating opening, said frame defining a plurality of substantially aligned, parallel passages for communicating said ventilating opening to ambient atmosphere, each of said passages extending from one end exposed to the atmosphere to another end exposed to said ventilating opening, at least a portion of said other end being oriented above said one end;

a plurality of valve members, each said valve member being freely movable within one of said passages between an opened position wherein each said valve member is urged by gravity toward said one end of said passage thereby permitting airflow through said ventilating opening and a closed position wherein each said valve member is moved by ambient wind pressure toward said other end of said passage thereby substantially blocking airflow through said ventilating opening.

11. A ventilating device as claimed in claim 10 wherein said one end of each of said passages defines an exhaust opening larger than said valve member, said other end defining an intake opening smaller than said valve member.

12. A ventilating device as claimed in claim 11 further comprising a screen mounted across said exhaust openings to retain said valve members within said passages and to prevent ingestion of wind driven debris into said passages.

13. A ventilating device as claimed in claim 10 wherein the structure includes a roof having a V-shaped ridge formed by two upwardly sloping sides, said ventilating opening extending longitudinally along said ridge, said plurality of passages including two rows of passages, one of said rows following said ventilating opening along one of said sloping sides and the other of said rows following said ventilating opening along the other of said sloping sides, said frame extending between said rows to cover said ventilating opening.

14. A ventilating device as claimed in claim 10 wherein said structure includes a vertical wall defining said ventilating opening, said plurality of passages forming a grid of passages within said ventilating opening, said grid following the plane of said wall.

15. A ventilating device as claimed in claim 14 wherein each of said passages includes an inclined surface from said exhaust opening to said intake opening, said valve member moving along said inclined surface when moving between said opened and said closed positions, and side surfaces which taper toward one another with distance from said exhaust opening to guide said valve member into sealing engagement with said intake opening when in said closed position.

16. A ventilating device as claimed in claim 12 wherein said frame includes a seating surface defining the perimeter of said passage intake opening, said sphere engaging said seating surface when in said active position.

17. A ventilating device for a structure having a soffit defining a ventilating opening therein for communicating air between an interior space within said structure and the atmosphere, said device comprising:

a frame substantially conforming to said ventilating opening for mounting therein, said frame defining a vertical passage extending upwardly from said ventilating opening into said interior space from an exhaust opening substantially planar with said ventilating opening to an intake opening above said exhaust opening;

a grill extending across said exhaust opening for preventing entry of objects into said passage; and a sphere situated within said passage, said sphere being freely movable within said passage between an inactive position wherein said sphere rests on top of said grill to permit airflow through said passage around said sphere and an active position wherein said sphere blocks said intake opening to block airflow through said passage, said orb moving into said active position in response to a predetermined amount of wind pressure entering said exhaust opening.

18. A ventilating device for a structure having a ventilating opening, said device comprising:

a frame extending across said ventilating opening, said frame defining a passage for communicating said ventilating opening to ambient atmosphere;

a valve member enclosed within said passage movable between an opened position to communicate said ventilation opening to atmosphere when the ambient wind speed is below a predetermined speed and a closed position to block said passage to prevent ingestion of wind blown moisture into said structure through said ventilation opening when said ambient wind speed exceeds said predetermined speed; and a valve seat disposed within said passage, said valve member being disengaged from said valve seat when in said opened position and engaging said valve seat when in said closed position, said passage including side surfaces which taper toward said valve seat to guide said valve member into said engagement with said valve seat.

19. A ventilating device as claimed in claim 18 wherein said frame defines a plurality of said passages.

20. A ventilating device as claimed in claim 19 wherein each of said passages includes one end adjacent said ventilating opening and another end spaced away from said ventilating opening, each said valve member being located at said one end when in said opened position.

21. A ventilating device as claimed in claim 20 further comprising a screen covering each of said one ends, each of said valve members engaging said screen when in said opened position.

22. A ventilating device as claimed in claim 21 wherein said valve members are spherical in shape.

23. A ventilating device as claimed in claim 21 wherein said valve members are cylindrical in shape.

* * * * *